United States Patent [19]

Knoch

[11] Patent Number: 4,550,772

[45] Date of Patent: Nov. 5, 1985

[54] HEAT RECOVERY DEVICE FOR EXHAUST FLUES

[76] Inventor: Darrell G. Knoch, C/O Miracle Heat, Inc. P.O. Box 553, Escanaba, Mich. 49829

[21] Appl. No.: 480,854

[22] Filed: Mar. 31, 1983

[51] Int. Cl.[4] ..... F28D 7/02

[52] U.S. Cl. ..... 165/47; 165/901

[58] Field of Search ..... 165/47, DIG. 2, DIG.12, 165/DIG. 13, 122, 164; 237/55

[56] References Cited

U.S. PATENT DOCUMENTS

| | | | |
|---|---|---|---|
| 4,028,817 | 6/1977 | Winstel | 165/DIG. 2 X |
| 4,125,153 | 11/1978 | Stoneberg | 165/DIG. 2 X |
| 4,147,303 | 4/1979 | Talucci | 237/55 |
| 4,176,709 | 12/1979 | Johnson | 237/55 X |
| 4,235,286 | 11/1980 | Behlau | 237/55 X |
| 4,303,122 | 12/1981 | Powell | 165/DIG. 2 X |
| 4,313,562 | 2/1982 | White | 237/55 |
| 4,326,344 | 4/1982 | Smith | 165/DIG. 2 X |

*Primary Examiner*—Michael Koczo

*Attorney, Agent, or Firm*—Michael, Best & Friedrich

[57] ABSTRACT

The heat recovery device has a flue pipe assembly including a section of standard flue pipe carrying a plurality of hollow, cylindrical heating tubes extending diametrically through the flue pipe section in axially spaced, parallel relationship and a separate housing defining an air flow chamber surrounding a portion of the flue pipe section. A fan inside the housing draws ambient air into the housing through an ambient air inlet located on the same side of the flue pipe assembly as the inlet of the heating tubes and propels a flow of air both through the heating tubes and over the outer surface of the flue pipe section towards a heated air outlet located on the same side of the flue pipe section as the discharge ends of the heating tubes. The flue pipe assembly is removably mounted on the housing so it can be removed in the event it fatigues and/or becomes plugged with carbon or creosote deposits during use. A thermostat on the flue pipe section turns the fan on and off when the temperature in the flue pipe section is respectively above and below a predetermined temperature. The total open area of the ambient air inlet and the heated air outlet is large enough so that, in the event the fan is inoperative, the natural flow of ambient air through the heating tubes and over the outer surface of the flue pipe is sufficient to prevent the flue pipe section from overheating.

9 Claims, 8 Drawing Figures

Fig. 2.
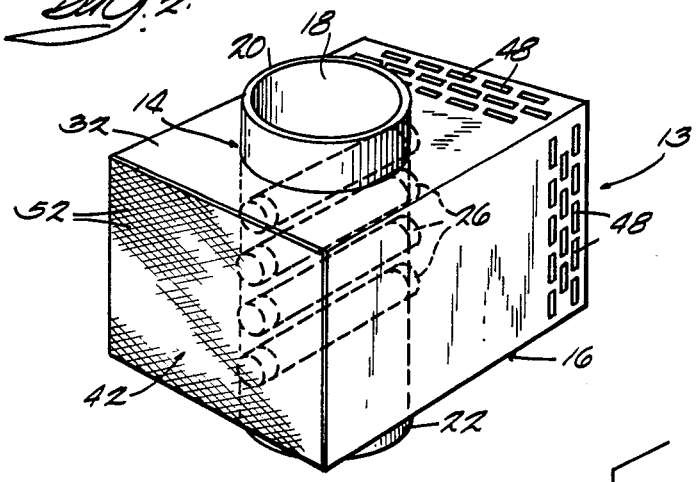
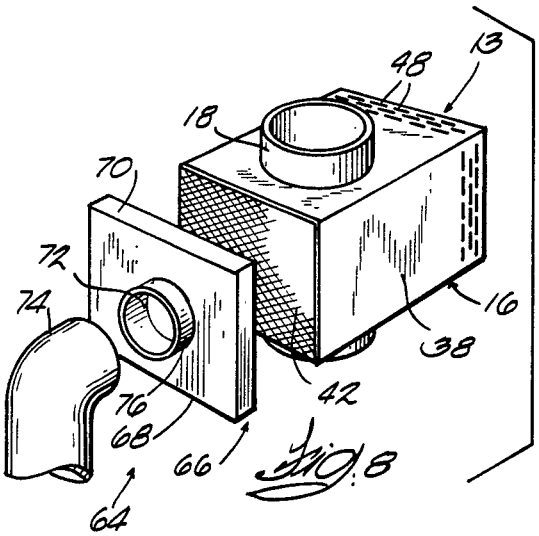
Fig. 8
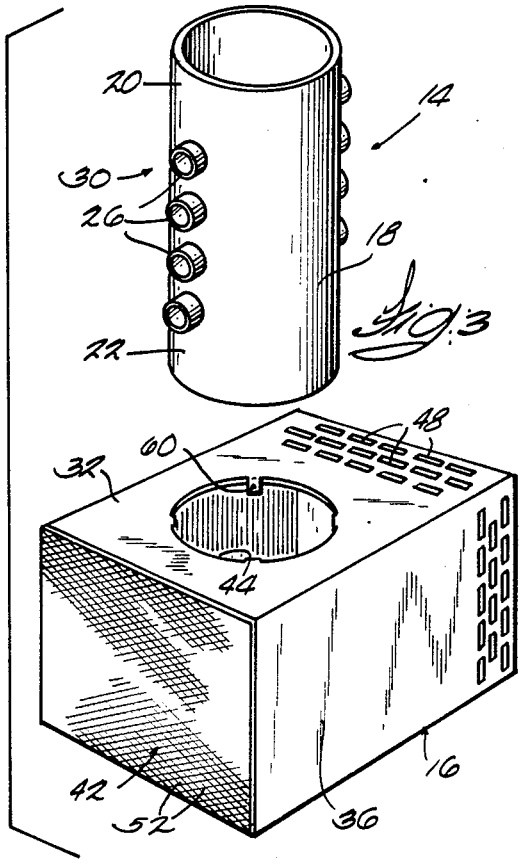
Fig. 3
Fig. 1
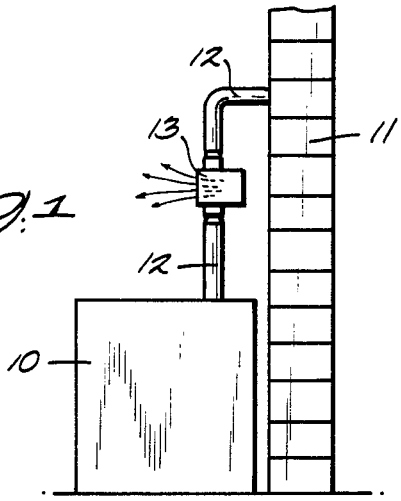

HEAT RECOVERY DEVICE FOR EXHAUST FLUES

BACKGROUND OF THE INVENTION

This invention relates to heat recovery devices and, more particularly, to devices for recoving heat normally lost from a flue for hot gases from a stove, furnance, hot water heater or the like and recirculating same for use in heating a room or building.

It is well known that the efficiency of furnances and stoves for heating buildings, particularly those burning fossil fuels and wood, is substantially reduced because of the loss of a large amount of the heat energy in the combustion gases exhausted to the atmosphere through a flue and chimney.

Numerous different types of devices have been proposed for recovering some of the waste heat from the exhaust flue and recirculating it directly back into the building or to another part of the heating system. In one type device, the hot flue gases pass over the outer surfaces of a plurality of transversely extending heating tubes. Ambient air passing through these tubes, either by natural flow or propelled by a blower, is heated and recirculated back into the room. Examples of this type device are disclosed in U.S. Pat. Nos. 2,882,023 (Rizzo), issued Apr. 14, 1959, 4,028,817 (Winstel), issued June 14, 1977, 4,176,709 (Johnson), issued Dec. 4, 1979, 4,235,286 (Behlau), issued Nov. 25, 1980 and 4,363,353 (Pranatis), issued Dec. 12, 1982.

This type device typically includes a relatively large number of small heating tubes which can cause a significant cooling of the flue gases. When a wood containing tars or creostoe is being used as the fuel, the flue gases can be cooled to the point where these tars or creosote separate and deposit on the outer surfaces of the heating tubes. Carbon or soot can also deposit on the heating tubes when fossil fuels and other types of wood are being burned. Such deposits can severely restrict the flow of the flue gases.

In another type device, air is heated as it passes through a housing surrounding the exhaust flue. Examples of this type device are disclosed in U.S. Pat. Nos. 2,468,909 (Yeager et al.), issued May 3, 1949, and 4,278,126 (Skrzypek), issued July 14, 1981. This type device usually is substantially less efficient in recovering the waste heat.

Examples of other types heat recovery devices are disclosed in U.S. Pat. No. 4,276,929 (Howard), issued July 7, 1981, and French Pat. No. 871,937, published May 22, 1942. The device disclosed in the first patent is quite complicated and bulky and requires a relatively large outer chamber including a baffling system for directing air in opposite directions through two different sections of transversely extending heating tubes in an inner chamber through which the flue gases pass. In the device disclosed in the latter patent, the gases flow through a chamber surrounding an ambient air duct and also through a pipe extending transversely through the air duct.

Prior devices known to applicant including heating tubes arranged for air to pass transversely through the flue gases and some kind of fan or blower to improve heat recovery and recirculation of the recovered heat are relatively complex and require some modification to the existing flue system, making them relatively expensive to manufacture and difficult to install. Also, they are arranged so that, in the event the portion through which the flue gases flow fatigues and/or becomes plugged with carbon or creosote deposits during use, the entire unit must be replaced.

SUMMARY OF THE INVENTION

An object of the invention is to provide a simple device for effeciently recovering and recirculating heat normally lost from the exhaust flue of a stove, furnance or the like.

Another object of the invention is to provide such a device which is inexpensive to manufacture and convenient to install in an existing flue system.

A further object of the invention is to provide such as device having a flue pipe section for heating air passing through tubes extending transversely through the flue pipe section and a separate housing defining a chamber for heating air flowing around and over the outer surface of the flue pipe section.

A still further object of the invention is to provide a heat recovery device described in the next preceding paragraph wherein the flue pipe section is removably mounted on the housing so it can be conveniently replaced in the event it fatigues and/or becomes plugged with carbon or creosote deposits during use.

Other objects, aspects and advantages of the invention will become apparent to those skilled in the art upon reviewing the following detailed description, the drawing and the appended claims.

The heat recovery device provided by the invention includes a section of flue pipe adapted for connection to the existing flue, a plurality of heating tubes extending transversely through the flue pipe so that the hot flue gases flow over the outer surfaces thereof, a housing defining an air flow chamber surrounding a portion of the flue pipe section, and fan means inside the housing for drawing ambient air into the housing throuh an air inlet located on the same side of the flue pipe section as the inlet ends of the heating tubes and propelling a flow of air both through the heating tubes and over the outer surface of the flue pipe section toward a heated air outlet located on the same side of the flue pipe section as the discharge ends of the heating tubes. The flue pipe section preferably is removably mounted on the housing so it can be removed and replaced in the event it fatigues and/or becomes plugged with carbon or creosote deposits during use.

In one embodiment, the heating tubes are disposed in a single axially extending row and extend diametrically through the flue pipe section in axially spaced, parallel relationship in order to minimize resistance to the flow of flue gases through the flue pipe section.

In one embodiment, a temprature sensing means is provided for turning the fan means off and on when the temperature of the flue pipe section is respectively above and below a predetermined level. The total open area of the air inlet and the air outlet preferably is large enough so that, in the event the fan means is inoperative, the natural flow of ambient air through the heating tubes and over the outer surface of the flue pipe is sufficient to prevent the flue pipe section from overheating.

BRIEF DESCRIPTION OF THE DRWING

FIG. 1 is a schematic view illustrating the heat recovery device of the invention installed in the flue of a wood burning stove.

FIG. 2 is a perspective view of the heat recovery device apart from the stove and flue.

FIG. 3 is an exploded, perspective view of the heat recovery device shown with the flue pipe assembly removed from the housing.

FIG. 8 is an exploded, perspective view of the heat recovery device and an auxiliary hot air flow director adapted to fit over the front of the housing for directing heated air to a remote location.

DESCRIPTION OF THE PREFERRED EMBODIMENTS

Figure 7:
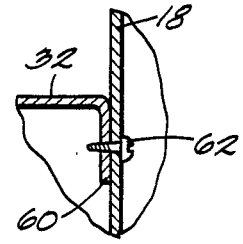
FIG. 7 is an enlarged, fragmentary, sectional view taken generally along line 7—7 in FIG. 6.

The heat recovery device of the invention can be adapted for use in exhaust flues of a wide variety of heating devices including fuel burning stoves and furnances, gas-fired water heaters, large dryers and the like. It is particularly adapted for use with wood and coal burning home heating stoves and will be described in connection with the application.

Illustrated in the drawing is a wood burning stove 10 connected to a chimney 11 by standard 6- or 8-inch stove flue pipe 12. The heat recovery device 13 of the invention includes two separate subassemblies, a flue pipe assembly 14 which fits into the existing flue pipe 12 and a housing 16 which encircles and defines an air flow chamber surrounding a portion of the flue pipe assembly 14.

The flue pipe assembly 14 includes a section 18 of standard metal flue pipe of the same diameter as the existing flue pipe 12. Thus, the opposite ends 20 and 22 of the flue pipe section 18 can be slipped over the ends of the existing flue pipe 12 and the hot combustion gases from the stove 10 flow through the interior of the flue pipe section 18 enroute to the chimney 11.

Figure 4:
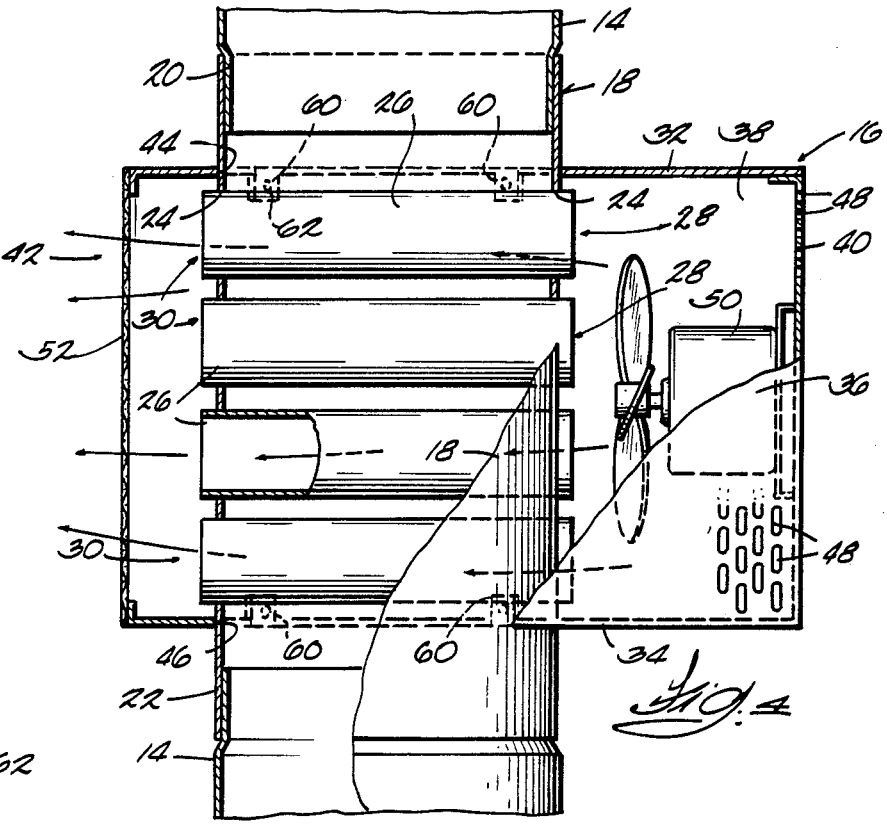
FIG. 4 is an enlarged, partially broken away, side elevation view of the heat recovery device shown installed like in FIG. 1.
Figure 5:
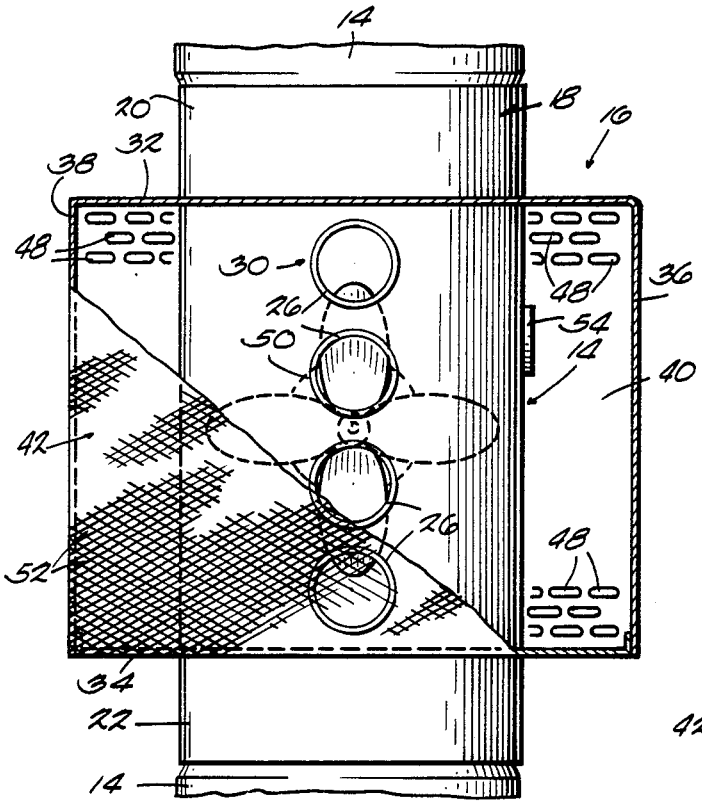
FIG. 5 is an enlarged, partially broken away, front elevation view of the heat recovery device shown installed like in FIG. 1.
Figure 6:
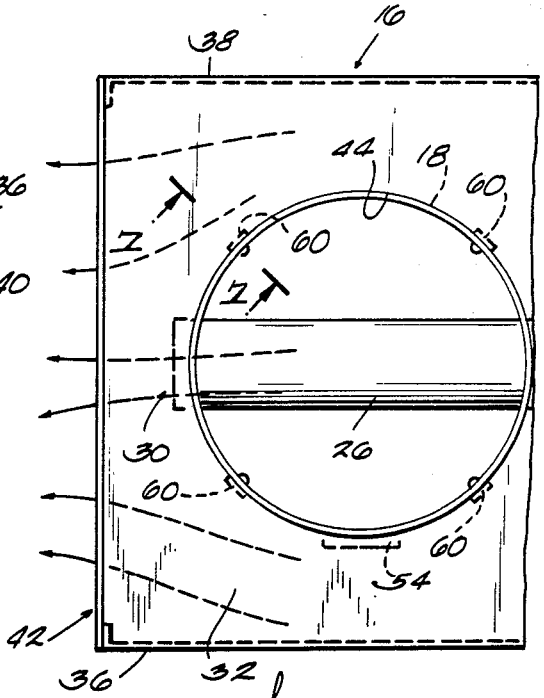
FIG. 6 is an enlarged, fragmentary, top plan view of the heat recovery device.

The flue pipe section 18 (FIG. 4) includes a plurality of axially spaced, diametrically opposed, circular apertures 24, each of which receive a hollow, cylindrical heating tube 26. The heating tube 26 are made from a heat conductive material, such as metal, and ambient air passing through the interior is heated by the combustion gases flowing over the outer surfaces thereof. Air enters inlet ends 28 of the heating tubes 26 and exits through the opposite discharge ends 30.

The outside diameter of the heating tubes 26 preferably is approximately the same as the diameter of the apertures 24 so there is substantially a press fit between the heating tubes 26 and the apertures 24 to provide a gas tight seal. Although not essential for most applications, the heating tubes 26 can be brazed or otherwise bonded to the flue pipe section 18 around the apertures 24 in order to provide a further gas seal. The heating tubes 26 can be slightly longer than the outside diameter of the flue pipe section 18 so that the opposite ends extend a small distance (e.g., ½ inch) past the outer surface of the flue pipe section 18.

A relatively small number of heating tubes 26 is used in order to minimize restriction to the flow of combustion gases through the flue pipe section 18. In the specific instruction illustrated, the flue pipe section 18 is cut from a standard 6-inch diameter, 24 gauge galvanized metal flue pipe. There are four heating tubes 26, and the heating tubes 26 are made from a thin metal and have a 1½ inch diameter. As a guide, the flue pipe section 18 can be approximately 12 inches long.

While the heating tubes 26 can be disposed in different arrays in the flue pipe section 18, the apertures 24 preferably are formed so that the heating tubes 26 are parallel to each other, extend diametrically through the center line or longitudinal axis of the flue pipe section 18 and are axially aligned in a single row. This further minimizes interference with the flow of combustion gases through the interior of the flue pipe section 18. That is, in the event there is any build-up of carbon or creosote deposits on the outer surfaces of the heating tubes 26, only that on the opposite sides of the tubes will cause a reduction in the internal flow area of the flue pipe section 18. Any build-up on the tops and bottoms of the heating tube 26 and between the heating tubes 26 does not affect the flow area.

The housing 16 includes opposed top and bottom walls 32 and 34, opposed side walls 36 and 38, a back wall 40 and a front 42. While other configurations can be used, in the specific construction illustrated, the housing 16 is generally rectangular and, as a guide, can be 10 inches wide, 12 inches long and 8 inches tall. The top and bottom walls 32 and 34 include opposed circular apertures 44 and 46 for receiving the flue pipe section 18 and cooperate with the back wall 40 and the side walls 36 and 38 to define an air flow chamber surrounding the flue pipe section 18.

The top, bottom, side and rear walls of the housing 16 preferably are made from a relatively thin, light weight material, such as 24 gauge galvanized metal. While the top, bottom, side and rear walls can be separate parts, in the preferred construction illustrated, the bottom wall 34 and the back wall 40 are bent from one piece of material and the top wall 32 and the side walls 36 and 38 are bent from one piece. These two pieces are fastened together by suitable means such as metal screws (not shown) or the like.

The rear portions of the top wall 32, the bottom wall 34, the side walls 36 and 38, and the rear wall 40 include a plurality of openings 48 which serve as an inlet for admitting ambient air into the housing 16 on the same side of the flue pipe section 18 as the inlet ends 28 of the heating tubes 26. In the specific instruction illustrated, the air inlet openings 48 are in the form of elongated slots. These openings can be in the form of louvers pressed into the sheet metal to improve the air flow and structural integrity.

A fan 50 mounted inside the housing 16 on the back wall 40 draws ambient air through the inlet openings 48 into the housing 16 and propels a flow of air both through the heating tubes 26 and over the outer surface of the flue pipe section 18 toward the front 42 of the housing 16. The front 42 includes a plurality of openings 52 through which the heated air exiting from the discharge ends 30 of the heating tubes 26 and flowing around the flue pipe section 18 is discharged from the housing 16. While various arrangements can be used, in the specific construction illustrated, the front 42 is covered by an expanded metal type grating.

Mounted on the flue pipe section 18 inside the housing 16 is a temperature sensing means, such as a bi-metallic thermostat 54, which is operatively connected to the fan 50 to turn the fan 50 on when the temperature of the flue pipe section 18 reaches a predetermined level (e.g., 120° F.) and to turn the fan 50 off when that temperature falls below the predetermined level. Thus, the fan 50 does not operate unless the stove 10 is burning fuel and the flue pipe section 18 is hot enough to provide auxiliary heating.

The total area of the ambient air inlet openings 48 and the heated air outlet openings 52 is large enough so that, in the event the fan 50 becomes inoperative because of power outage or the like, the natural flow of ambient air through the heating tubes 26 and over the outer surface of the flue pipe section 18 is sufficient to prevent the flue pipe section from overheating.

The flue pipe section 18 preferably is removably mounted on the housing 16 so that, in the event the flue pipe assembly 14 fatigues and/or becomes partially plugged with carbon or creosote deposit during use, it can be removed and replaced with a new one. In the specific consturction illustrated, the top wall 32 and the bottom wall 34 are provided with a plurality of inturned, axially extending tabs 60 circumferentially spaced around the perimeter of the apertures 44 and 46. The flue pipe section 18 (FIG. 7) is removably fastend to the tabs 60 by metal screws 62 extending through the flue pipe section 18 and threaded into the tabs 60.

FIG. 8 illustrates a hot air flow director 64 which can be slipped over the front 42 of the housing 16 when it is desired to direct the heated air to a specific remote area, such as the hot air duct of a forced air home heating system. The flow director 64 includes a box-like adapter 66 having a cover 68 for covering the front 42 of the housing 16 and a peripheral flange 70 which slips over the front edges of the top, bottom and side walls. The cover 68 includes a sleeved, central outlet port 72 of approxmately the same diameter as the flue pipe section 18. One end of an air duct 74, such as a standard flue pipe or a flexible hose, fits over the port sleeve 76 in communication with the outlet port 72 and the other end is located in a remote area where additional heat is desired or connected to the hot air duct of the home heating system.

From the foregoing description, one skilled in the art can easily ascertain the essential characteristics of the invention and, without departing from the spirit and scope thereof, make various changes and modifications to adapt it to various usages.

I claim:

1. A device for recovering and recirculating heat normally lost from the exhaust flues of a stove, furnace or the like, having a cylindrical flue said device including a section of cylindrical flue pipe which has opposite ends adapted for connection to the existing cylindrical flue, which has an inside diameter substantially the same as that of the existing flue and through which the hot flue gases flow;

a plurality of hollow heating tubes extending diametrically through said flue pipe section so that the hot flue gases flow over the outer surfaces thereof, said heating tubes having opposite air inlet and discharge ends and being disposed in a single axially extending row;

a housing defining an air flow chamber completely surrounding the portion of said flue pipe section containing said heating tubes, said housing having an ambient air inlet on the same side of said flue pipe section as the inlet ends of said heating tubes and a heated air outlet on the same side of said flue pipe section as the discharge ends of said heating tubes; and fan means inside said housing for drawing ambient air into said housing through said air inlet and propelling a flow of air toward said heated air outlet, both through said heating tubes and over the outer surface of the portion of said flue pipe section inside said housing.

2. A device according to claim 1 wherein said heating tubes are disposed in axially spaced, parallel relationship.

3. A device according to claim 1 wherein said fluid pipe section is removably mounted on said housing.

4. A device according to claim 3 wherein said housing includes a pair of opposed walls, each having an aperture for receiving said flue pipe section, and a plurality of axially extending, circumferentially spaced tabs around the perimeter of said aperture; and said flue pipe section is mounte on said housing by fastening means removably fastening said flue pipe section to said tabs.

5. A device according to claim 4 wherein said fastening means comprise screws extending through said flue pipe section and threaded into said tabs.

6. A device according to claim 1 including temperature sensing means for turning said fan means on and off when the temperature of said flue pipe section is respectively above and below a predetermined level.

7. A device according to claim 1 wherein said flue pipe section is made from a standard sheet metal flue pipe.

8. A device according to claim 1 wherein said housing has a front end including said heated air outlet; and said device further includes a heated air flow director comprising an adapter including a cover for covering said heated air outlet and having a peripheral flange adapted to fit over said housing front end, an outlet port in said cover, and a duct having one end connected in communication with said outlet port and adapted to direct heated air from said housing to a remote location.

9. A device for recovering and recirculating heat normally lost from the exhaust flue of a stove, furnace or the like, said device including a section of flue pipe which has opposite ends adapted for connection to the existing flue and through which the hot flue gases flow;

a plurality of hollow heating tubes extending diametrically through said flue pipe section in axially spaced, parallel relationship in a single axially extending row so that the hot flue gases flow over the outer surfaces thereof, said heating tubes having oppsosite air inlet and discharge ends;

a housing having opposed walls including coaxial apertures receiving said flue pipe section and defining an air flow chamber completely surrounding the portion of said flue pipe section containing said heating tubes, said housing having an ambient air inlet on the same side of said flue pipe section as the inlet ends of said heating tubes and a heated air outlet on the same side of said flue pipe section as the discharge ends of said heating tubes;

means for removably mounting said flue pipe section on said housing; and fan means inside said housing for drawing ambient air into said housing through said air inlet and propelling a flow of air toward said heated air outlet, both through said heating tubes and over the outer surface of the portion of said flue pipe section inside said housing.

* * * * *